US006110358A

United States Patent [19]

Aldous et al.

[11] Patent Number: 6,110,358

[45] **Date of Patent: *Aug. 29, 2000**

[54] PROCESS FOR MANUFACTURING IMPROVED PROCESS OILS USING EXTRACTION OF HYDROTREATED DISTILLATES

[75] Inventors: Keith K. Aldous, League City; Jacob B. Angelo, Spring, both of Tex.; Joseph P. Boyle, Baton Rouge, La.

[73] Assignee: Exxon Research and Engineering Company, Florham Park, N.J.

[ * ] Notice: This patent is subject to a terminal disclaimer.

[21] Appl. No.: 09/316,659

[22] Filed: May 21, 1999

[51] Int. Cl.[7] ..... C10G 45/00

[52] U.S. Cl. ..... 208/212; 208/96; 208/209; 208/254 H; 208/88

[58] Field of Search ..... 208/212, 96, 209, 208/254 H, 88

[56] References Cited

U.S. PATENT DOCUMENTS

| | | | |
|---|---|---|---|
| 2,734,019 | 2/1956 | Miller et al. | 208/212 |
| 3,514,395 | 5/1970 | McVay et al. | 208/96 |
| 4,085,036 | 4/1978 | Murphy, Jr. et al. | 208/212 |
| 4,801,373 | 1/1989 | Corman et al. | 208/210 |
| 5,840,175 | 11/1998 | Aldous et al. | 208/87 |
| 5,846,405 | 12/1998 | Aldous et al. | 208/211 |
| 5,853,569 | 12/1998 | Aldous et al. | 208/212 |
| 5,925,234 | 7/1999 | Morel et al. | 208/96 |
| 6,024,864 | 2/2000 | Aldous et al. | 208/212 |

*Primary Examiner*—Walter D. Griffin
*Assistant Examiner*—Nadine Preisch
*Attorney, Agent, or Firm*—Joseph J. Dvorak

[57] ABSTRACT

A method for producing a process oil in which a naphthenic rich distillate is processed through a single hydrotreating stage, the hydrotreated distillate is then solvent extracted to yield a process oil which passes IP-346 and AMES screening test.

10 Claims, 1 Drawing Sheet

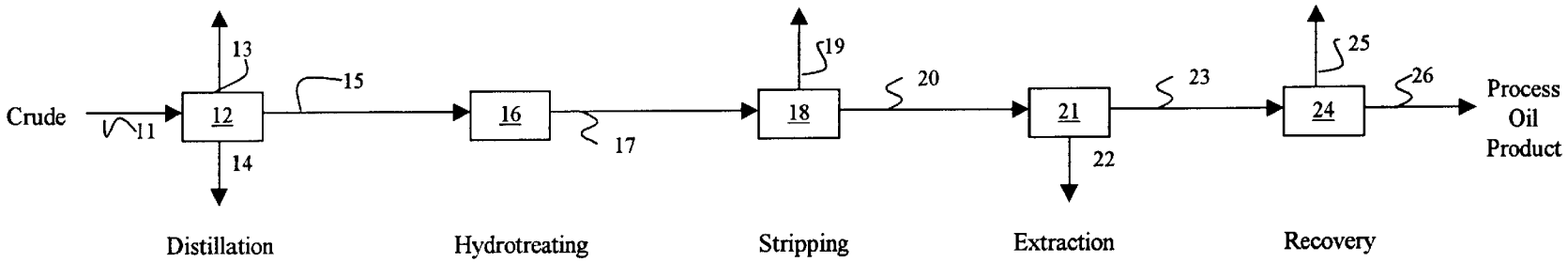
Crude
11
12
13
14
Distillation
15
16
Hydrotreating
17
18
19
Stripping
20
21
22
Extraction
23
24
25
Recovery
26
Process Oil Product

PROCESS FOR MANUFACTURING IMPROVED PROCESS OILS USING EXTRACTION OF HYDROTREATED DISTILLATES

FIELD OF THE INVENTION

This invention is concerned with improved process oils and their method of preparation.

BACKGROUND OF THE INVENTION

A product line of light (135 SSU @ 100° F.), intermediate (1000 SSU @ 100° F.) and heavy (3000 SSU @ 100° F.) hydrofinished process oils, manufactured from the corresponding distillates of naphthenic crudes, are known as Coastal Pale Oils (CPO's). These oils have many uses in industry; however, the principal end-use of a CPO is as a major ingredient in rubber process oils.

Today there is a growing demand from end-users for process oils with high solvency. In addition, there is a need for oils which are sufficiently low in aromatics content, especially polynuclear aromatics content. Simultaneously, the availability of conventional naphthenic crudes is declining. Thus, there is a need for a process which provides process oils, especially CPO's with high solvency and which process utilizes a lesser amount of naphthenic distillate.

SUMMARY OF THE INVENTION

Very simply stated, one embodiment of this invention comprises extracting a hydrotreated naphthenic distillate under aromatic extraction conditions sufficient to produce a process oil having an aniline point between about 80° C. to about 120° C.

This and other embodiments of the present invention will become apparent upon reading the detailed description in conjunction with the accompanying drawing.

BRIEF DESCRIPTION OF THE DRAWING

The accompanying FIGURE is a schematic diagram of the process of the present invention.

DETAILED DESCRIPTION OF THE INVENTION

Referring to the FIGURE, a naphthenic crude feedstock is fed via line 11 to a pipestill 12 to produce via distillation a suitable naphthenic distillate useful in the present invention. As shown volatile overheads and heavy bottoms are taken off via lines 13 and 14 respectively. As will be readily appreciated, depending upon the operating parameters of the pipestill various cuts of naphthenic distillates can be obtained, each of which can be processed according to the invention; e.g., 135 SSU @ 100° F., 1000 SSU @ 100° F. and 3000 SSU @ 100° F. However, for simplicity, the present invention will be described in detail with respect to a single naphthenic distillate.

As shown in the FIGURE, a naphthenic distillate is fed through line 15 to a hydrotreating reactor 16 where it is treated in a single hydrotreating stage to convert at least some of the sulfur and nitrogen present in the distillate to ammonia and hydrogen sulfide. Preferably the hydrotreating stage is maintained within a temperature range of about 300° C. to 375° C. and more preferably within the range of about 340° C. to 365° C., a hydrogen partial pressure in the range of about 300 to 2500 psia and preferably in the range of about 500 to 1200 psia. The hydrotreating is usually done at a space velocity (v/v/hr) in the range of about 0.1 to 2 v/v/hr.

The catalyst used in hydrotreating is not critical. It may be any one of those known and used in the art such as nickel sulfides, cobalt sulfides, molybdenum sulfides, and tungsten sulfides and combinations of these.

After hydrotreating the naphthenic distillate, the hydrotreated distillate is passed by line 17 to separator 18 where hydrogen sulfide and ammonia formed during the hydrotreating stage are removed via line 19 by any convenient means from the feed. For example, an inert stream such as steam can be used to strip the hydrogen sulfide and ammonia from the hydrotreated material by using techniques well-known in the art.

After removing the hydrogen sulfide and ammonia the separated distillate is transferred by line 20 to an aromatic extraction unit 21. Here the hydrotreated and separated naphthenic distillate is extracted with an aromatic extraction solvent under conditions sufficient to provide a process oil having an aniline point of about 80° C. to about 120° C. In general this is achieved by extracting to recover as raffinate more than about 80 liquid volume % (LV %) of the hydrotreated distillate, for example from about 80 to 95 LV %. Typical aromatic extraction solvents include n-methyl pyrrolidone, phenol, n-n-dimethyl-formamide, dimethylsulfoxide, methylcarbonate, morpholine, furfural, and the like. Preferably, n-methylpyrrolidone or phenol is used as the solvent. Solvent to oil treat ratios are generally from about 1:1 to about 3:1. The extraction solvent preferably contains water in the range of about 1 volume % to about 20 volume %. Basically the extraction can be conducted in a counter-current type extraction unit.

As is shown in the FIGURE, extract solution containing solvent and extract oil is removed via line 22 while the raffinate, which will include some solvent, is sent by line 23 to a solvent stripping zone 24. Here solvent is removed by line 25 and the product process oil by line 26. The resultant process oil has an aromatic content of about 20 to 40% by weight.

The invention will be further illustrated by reference to the following examples and comparative examples.

COMPARATIVE EXAMPLE 1

In this Comparative Example, a naphthenic feedstock having a viscosity of 135 SSU at 100° F. was passed through two hydrotreating stages under the conditions outlined in Table 1 below.

TABLE 1

DISTILLATE HYDROTREATING CONDITIONS

| | STAGE 1 | STAGE 2 |
|---|---|---|
| PROCESS VARIABLE | | |
| Temperature, ° C. | 355 | 315 |
| $H_2$ Partial Pressure, psia | 550 | 652 |
| Gas Treat, SCF $H_2$Barrel | 450 | 450 |
| Space Velocity, V/V/HR | 0.7 | 0.7 |
| YIELD ON VIRGIN DISTILLATE | | |
| 135 SSU Process Oil, LV% | 93 | 91 |
| 1000 SSU Process Oil, LV% | 92 | 90 |
| 3000 SSU Process Oil, LV% | 89 | 82 |

In this Comparative Example after hydrotreating under the conditions of stage 1 the material is stripped to remove hydrogen sulfide and ammonia. The product of the second stage represents a process oil having the properties shown in Table 2.

EXAMPLE 1

In this Example a naphthenic feedstock corresponding to that used in the Comparative Example 1 was passed through a single hydrotreating stage under the conditions set forth under Stage 1 of Table 1. The hydrotreated distillate was extracted using 7.0% water and phenol in a countercurrent extraction column in a treat ratio of 200% and at a temperature of 55° C. After removal of the solvent a process oil having the properties set forth in Table 2 was obtained. The yield of this raffinate was about 86 LV % on hydrotreated distillate feed which is 80 LV % on virgin distillate.

The product produced in this Example 1 passed the mutagenicity test and IP-346 (AMES) screening test for cancer potential of an oil. The product produced in Comparative Example 1 did not pass the IP-346 screening test.

TABLE 2

135 SSU PROCESS OIL

| | Comparative Example 1 | Example 1 |
|---|---|---|
| Properties | | |
| Specific Gravity, 60/60° F. | 0.8928 | 0.8844 |
| Aniline Point, ° F. | 179 | 190.4 |
| Sulfur, wt % | 0.11 | 0.07 |
| Viscosity, 100 ° F.,SSU | 119 | 117.9 |
| HPLC-2, wt % | | |
| Saturates | 69.8 | 71.0 |
| 1-ring aromatics | 21.9 | 19.5 |
| 2-ring aromatics | 5.9 | 3.4 |
| 3+ ring arom. & Polars | 2.4 | 6.3 |
| Mutagenicity Index | 0 (Pass) | 0 (Pass) |
| IP 346, wt % | 3.2 (Fail) | 1.1 (Pass) |
| Yield | | |
| On Virgin Distillate, LV % | 91 | 80 |

COMPARATIVE EXAMPLE 2

In this Comparative Example, a naphthenic feedstock having a viscosity of 1000 SSU at 100° F. was passed through two hydrotreating stages under the conditions outlined in Table 1 above.

In this Comparative Example after hydrotreating under the conditions of stage 1 the material is stripped to remove hydrogen sulfide and ammonia. The product of the second stage represents a process oil having the properties shown in Table 3.

EXAMPLE 2

In this example, a naphthenic feedstock corresponding to that used in the Comparative Example 2 was passed through a single hydrotreating stage under the conditions set forth under Stage 1 of Table 1. The hydrotreated distillate was extracted using 7% water in phenol in a countercurrent extraction column in a treat ratio of 200% and at a temperature of 65° C. After removal of the solvent a process oil having the properties set forth in Table 3, column 2, was obtained. The yield of this raffinate was about 86 LV % on the hydrotreated distillate feed which is 79 LV % on virgin distillate.

The product derived in this Example 2 passed both the muta-genicity test and the IP-346 (AMES) screening test for cancer potential of oil. The product derived in Comparative Example 2 failed the IP-346 test.

TABLE 3

1000 SSU PROCESS OIL

| | Comparative Example 2 | Example 2 |
|---|---|---|
| Properties | | |
| Specific Gravity, 60/60° F. | 0.9135 | 0.9036 |
| Aniline Point, ° F. | 199.6 | 210.2 |
| Sulfur, wt % | 0.20 | 0.17 |
| Viscosity, 100° F., SSU | 700.8 | 602.1 |
| HPLC-2, wt % | | |
| Saturates | 62.5 | 68.7 |
| 1-ring aromatics | 21.8 | 22.2 |
| 2-ring aromatics | 9.7 | 6.1 |
| 3+ ring arom. & Polars | 6.1 | 3.1 |
| Mutagenicity Index | 0 (Pass) | 0 (Pass) |
| IP 346, wt % | 3.4 (Fail) | 0.9 (Pass) |
| Yield | | |
| LV % on Virgin Distillate | 90 | 80 |

COMPARATIVE EXAMPLE 3

In this Comparative Example, a naphthenic feedstock having a viscosity of 3000 SSU at 100° F. was passed through two hydrotreating stages under the conditions outlined in Table 1 above.

In this Comparative Example after hydrotreating under the conditions of stage 1 the material is stripped to remove hydrogen sulfide and ammonia. The product of the second stage represents a process oil having the properties shown in Table 4.

EXAMPLE 3

In this example, naphthenic feedstock corresponding to that used in the Comparative Example 3 was passed through a simple hydrotreating stage under the conditions set forth under Stage 1 of Table 1. The hydrotreated distillate was extracted using 7% water and phenol in a countercurrent extraction column in a treat ratio of 200% and at a temperature of 70° C. After removal of the solvent a process oil having the properties set forth in Table 4, was obtained. The yield of the raffinate was about 87 LV % on hydrotreated distillate feed which is 77 LV % on virgin distillate.

The product derived in this Example 3 passed both the muta-genicity test and the IP-346 (AMES) screening test for cancer potential of oil. The product derived in Comparative Example 3 failed the IP-346 screening test.

TABLE 4

3000 SSU PROCESS OIL

| | Comparative Example 3 | Example 3 |
|---|---|---|
| Properties | | |
| Specific Gravity, 60/60° F. | 0.9197 | 0.9097 |
| Aniline Point, ° F. | 211.1 | 224.6 |
| Sulfur, wt % | 0.31 | 0.3 |
| Viscosity, 100° F., SSU | 1839.7 | 1451.0 |
| HPLC-2, wt % | | |
| Saturates | 55.6 | 63.3 |
| 1-ring aromatics | 22.2 | 23.8 |
| 2-ring aromatics | 11.5 | 8.6 |
| 3+ ring arom. & Polars | 10.7 | 4.2 |
| Mutagenicity Index | 0.8 (Pass) | 0 (Pass) |

TABLE 4-continued

| 3000 SSU PROCESS OIL | Comparative Example 3 | Example 3 |
|---|---|---|
| IP 346, wt % Yield | 3.4 (Fail) | 0.8 (Pass) |
| LV % on Virgin Distillate | 82 | 77 |

What is claimed is:

1. A method for producing a process oil comprising extracting a hydrotreated naphthenic distillate under aromatic extraction conditions to produce a process oil having an aniline point of between about 80° C. to about 120° C.

2. The method of claim 1 wherein the hydrotreated naphthenic distillate is obtained by hydrotreating a naphthenic rich feed in a single hydrotreating stage under hydrotreating conditions whereby hydrogen sulfide and ammonia are produced and removed to provide the hydrotreated distillate.

3. The method of claim 2 wherein the hydrotreating is conducted at a temperature of about 300° C. to about 375° C., a partial hydrogen pressure of about 300 to 2500 psia and at a space velocity of 0.1 to 2 (V/V/Hr).

4. The method of claim 3 wherein the hydrotreated distillate is extracted to provide a raffinate yield of from about 80 to about 95 LV %.

5. The method of claim 4 wherein the hydrotreated distillate is extracted with an aromatic extraction solvent at solvent to distillate ratio of from about 1:1 to about 3:1.

6. The method of claim 5 wherein the solvent contains water in the range of about 1 volume % to about 20 volume %.

7. A method for producing a process oil from a naphthenic rich distillate comprising:

hydrotreating the naphthenic rich distillate in a single hydrotreating stage at temperatures of about 300° C. to about 375° C., a partial hydrogen pressure of 300 to 2500 psia and a space velocity of 0.1 to 2 (VJV/Hr) whereby a hydro-treated distillate, hydrogen sulfide and ammonia are formed;

separating the hydrogen sulfide and ammonia from the hydrotreated distillate; and then extracting the hydrotreated distillate under aromatic extraction conditions sufficient to provide a process oil having an aniline point of between about 80° C. to about 120° C.

8. The method of claim 7 wherein the hydrotreated distillate is extracted with an aromatic extraction solvent at a solvent to distillate ratio of 1:1 to 3:1.

9. The method of claim 8 wherein the solvent contains from about 1 volume % to 20 volume % of water.

10. The method of claim 9 wherein the hydrotreated distillate is extracted to provide a raffinate yield of from about 80 to 95 LV %.

* * * * *